US006582022B2

(12) United States Patent
LaBlance

(10) Patent No.: US 6,582,022 B2
(45) Date of Patent: Jun. 24, 2003

(54) METHOD OF MAKING FURNITURE, AND FURNITURE MADE THEREBY

(76) Inventor: Steven J LaBlance, 1851 Horton Bay Rd., Petoskey, MI (US) 49770

( * ) Notice: Subject to any disclaimer, the term of this patent is extended or adjusted under 35 U.S.C. 154(b) by 34 days.

(21) Appl. No.: 09/766,304

(22) Filed: Jan. 19, 2001

(65) Prior Publication Data

US 2001/0045768 A1 Nov. 29, 2001

Related U.S. Application Data

(60) Provisional application No. 60/177,384, filed on Jan. 24, 2000.

(51) Int. Cl.[7] ..... A47C 7/00; B23P 11/00

(52) U.S. Cl. ..... 297/440.14; 29/525.11

(58) Field of Search ..... 297/440.14, 440.13, 297/440.1, 451.11; 29/428, 425.11, 557; 83/13; 144/359, 360, 363, 39

(56) References Cited

U.S. PATENT DOCUMENTS 2,670,787 A * 3/1954 Vandas et al.
3,527,498 A * 9/1970 Werner
3,675,692 A * 7/1972 Jeans
3,722,704 A * 3/1973 Piretti
4,169,639 A * 10/1979 Zola
4,380,336 A * 4/1983 Pratt
5,387,027 A * 2/1995 Maloney
5,720,093 A * 2/1998 Yoder, Jr.
5,765,922 A * 6/1998 Hsia
5,803,548 A * 9/1998 Battle
5,921,631 A * 7/1999 Bush
6,367,874 B2 * 4/2002 Casini

* cited by examiner

*Primary Examiner*—Milton Nelson, Jr.
(74) *Attorney, Agent, or Firm*—Weiner & Burt, P.C.; Irving M. Weiner; Pamela S. Burt

(57) ABSTRACT

Indoor/outdoor casual furniture are made from solid-state components all fabricated from a single sheet of polymer material. The furniture can be safely placed outdoors without risk of rot, mildew, or weathering. The method allows for interchangeable bench and chair backs.

11 Claims, 1 Drawing Sheet

FIG. 1
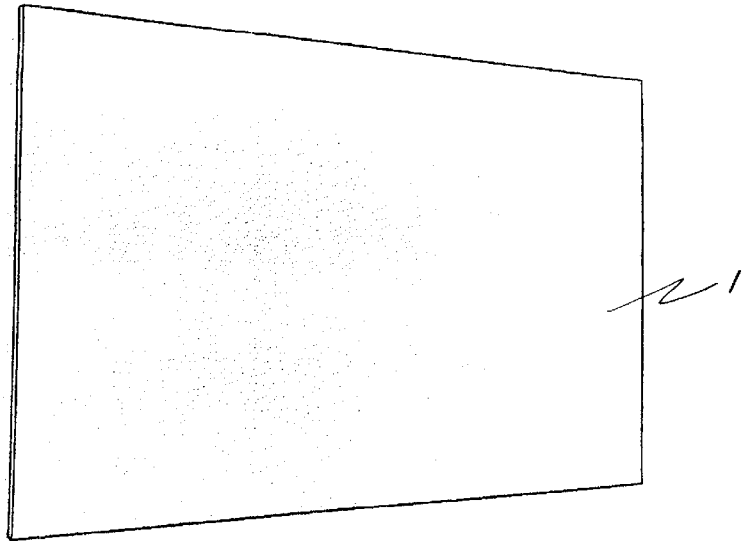
FIG. 2
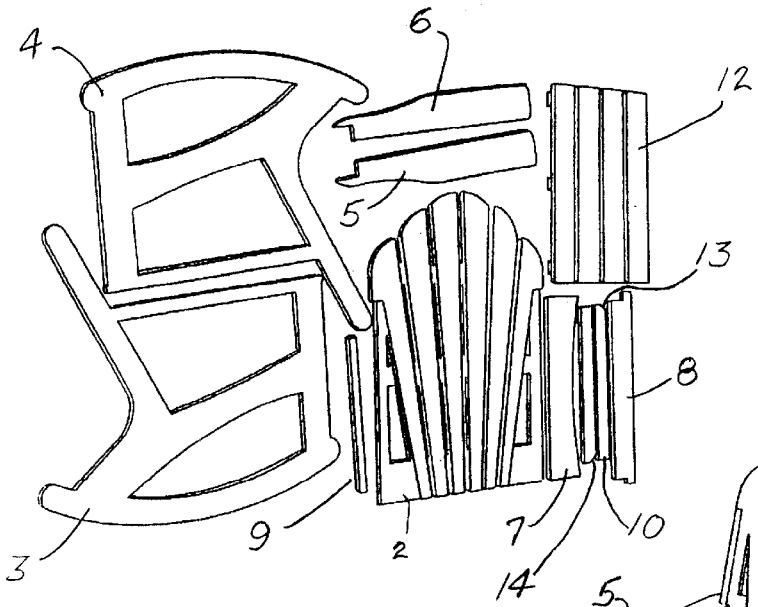
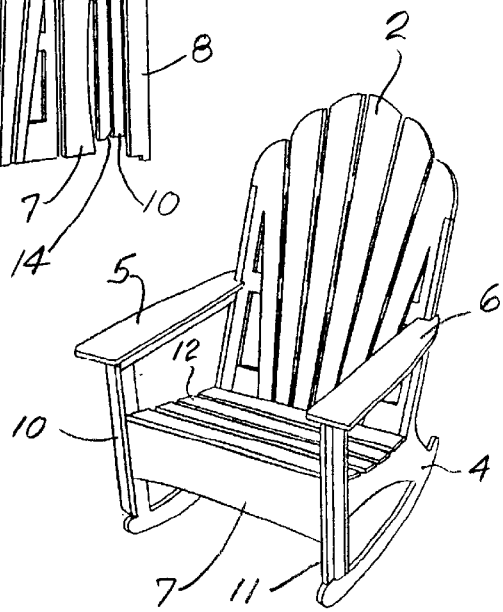
FIG. 3

METHOD OF MAKING FURNITURE, AND FURNITURE MADE THEREBY

The present patent application is based on and claims priority from U.S. Provisional Patent Application Serial No. 60/177,384 filed on Jan. 24, 2000.

The present invention relates generally to a method of making furniture, and furniture made thereby. In particular, the invention relates to a method of making furniture from polymer sheeting, and furniture made thereby.

BACKGROUND OF THE INVENTION AND DESCRIPTION OF THE RELEVANT ART

Conventional methods of making furniture, particularly indoor/outdoor casual furniture, entail a great number of parts and an even greater number of fasteners and joints, each of which is susceptible to failure. Such conventional methods include the traditional woodworking techniques.

The furniture resulting from such conventional methods is not resistant to rot or the ultraviolet rays of the sun, and requires repeated time-consuming and expensive maintenance.

Furthermore, such conventional methods do not lend themselves to creating unlimited number of styles by using various interchangeable components.

Various attempts have been tried to remedy and/or avoid the aforementioned problems, but such attempts have been unsuccessful.

The relevant art is exemplified by the following United States patents.

U.S. Pat. No. 2,670,787 issued in 1954 to Vandas et al. entitled "CHAIR OF MALLEABLE MATERIAL" discloses a chair made from a flat substantially rectangular blank of continuous malleable material. Such material may be plastic, metal, wood, or laminated material.

U.S. Pat. No. 3,527,498 issued in 1970 to Werner entitled "METHOD AND APPARATUS FOR CONSTRUCTING FURNITURE PIECES OF PLASTIC" discloses a method of constructing a furniture support surface of thin-walled plastic shells which has strength and impact distributing properties by using a cellular filler material between the shells. A satisfactory plastic is disclosed as ABS plastic (Acrylonitrile-Butadiene-Styrene plastic) sold by Borg-Warner Corp. under the trade name Cycolac.

U.S. Pat. No. 3,669,496 issued in 1972 to Chisholm entitled "CHAIR AND SEAT AND BACK UNIT THEREFOR" discloses a method of blow-molding a unitary chair seat and back unit and mounting it on a chair frame. The unit is molded in generally flat form, providing for storage and/or shipping with saving in space, and is then bent to angular form for mounting on the chair frame.

Other relevant art includes: Wilton U.S. Pat. No. 3,675,692; Piretti U.S. Pat. No. 3,722,704; and Yoder, Jr. U.S. Pat. No. 5,720,093.

It is a desideratum of the present invention is to avoid the animadversions of the conventional devices and techniques.

The present invention, in addition to eliminating or avoiding the problems and disadvantages attendant to the conventional devices and techniques, provides a novel furniture fabricating method and furniture produced thereby possessing very new and desirable features, heretofore unattainable.

SUMMARY OF THE INVENTION

The present invention provides a method of making pieces of high-strength weather-resistant indoor/outdoor furniture, comprising the steps of: designing components for a first piece of furniture which is suitable for indoor and/or outdoor use, and which may be changed in appearance to an unlimited number of styles by merely changing solid-state components though the removal of a few screws; cutting all said components from a single sheet of polymer having a predetermined thickness; and assembling said components with screws to form said first piece of furniture.

The present invention also provides novel high-strength weather-resistant indoor/outdoor furniture, comprising: components for a first piece of furniture which is suitable for indoor or outdoor use, and which may be changed in appearance to an unlimited number of styles by merely changing solid-state components though the removal of a few screws; all said components being fabricated from a single sheet of polymer having a predetermined thickness; and said components being assembled with screws to form said first piece of furniture.

The present invention provides a novel method of making high-strength weather-resistant indoor/outdoor furniture from polymer sheets, and furniture fabricated by such method.

It is an object of the present invention to provide furniture as described above which can be placed safely outdoors without rot, mildew, or weathering.

Another object of the invention is to provide a method of making furniture as described above whereby the furniture is fabricated from solid state components.

A further object of the invention is to provide a method and furniture as described above wherein the method eliminates many of the nails, screws, and other fasteners required by conventional methods and furniture.

Additional objects, features, and advantages of the invention will become apparent from the following detailed description and accompanying drawings.

BRIEF DESCRIPTION OF THE DRAWINGS

FIG. 1 illustrates polymer sheet employed for a first embodiment of the invention.

FIG. 2 shows a plurality of solid-state components all of which are fabricated from the polymer sheet depicted in FIG. 1.

FIG. 3 illustrates all of the components shown in FIG. 2 assembled into a completed rocking chair.

DETAILED DESCRIPTION OF ONE POSSIBLE PREFERRED EMBODIMENT OF THE INVENTION

With reference to FIG. 1, there is shown a sheet 1 of material from which all of the components 2 through 12 (shown in FIG. 2) of a piece of furniture 15 (illustrated in FIG. 3) may be processed. Preferably, but not necessarily, the invention can be implemented by using 4 foot by 8 foot sheets of polymer having a thickness of ¾ inch, ⅝ inch, and/or ½ inch.

The polymer sheet 1 is preferably, but not necessarily, of a solid color with no finishing of any type being required. Furthermore, the polymer sheet 1 is preferably, but not necessarily, matte finish on both major surfaces, and is maintenance free, rot resistant, UV resistant, and more resilient than wood, yet maintains the appearance of painted wood.

All of the components 2 through 12 shown in FIGS. 2 and 3 are cut from a single 4 foot by 8 foot sheet 1 of polymer in a manner which provides solid-state components.

In contrast, traditional woodworking techniques would have yielded a plethora of parts which require a multiplicity of fasteners and joints, each of which being susceptible to failure, and requiring a multiplicity of assembly steps.

The present invention provides a novel process which yields a minimum of components, each of which is solid-state and has no possibility of joint failure because there are no joints in the component. This is a very significant feature of the present invention.

Conventional methods use traditional woodworking techniques which require the mending and/or assembly of a multiplicity of parts. The present invention, on the other hand, provides a process which affords the opportunity for unlimited furniture designs because each 4 foot by 8 foot polymer sheet is treated like an art canvas, using a router like an artist would use a brush.

As shown in the particular illustrated embodiment, all of the solid-state components 2 through 12 required to produce the rocking chair 15 of FIG. 3 are fabricated from the single 4 foot by 8 foot polymer sheet 1 shown in FIG. 1 by using a router and/or other cutting tools.

Such components comprise a back piece 2, a right leg-arm piece 3, a left leg-arm piece 4, a right armrest 5, a left armrest 6, front seat piece 7, 8 and 9, stabilizers 10 and 11, and a main seat piece 12.

To assemble the chair 15, the right leg-arm piece 3 may be attached to the back piece 2 using a very small number of pan-head screws. Similarly, the left leg-arm piece 4 may also be attached to the back piece 2 using a very small number of pan-head screws.

Then the right arm rest 5 may be attached to the right leg-arm piece 3 and the back piece 2 using appropriate screws. Similarly, the left armrest 6 may be attached to the left leg-arm piece 4 and the back piece 2 using appropriate screws.

The front seat pieces 7, 8 and 9 (see FIGS. 2 and 3) are then attached to the right leg-arm piece 3 and the left leg-arm piece 4 using appropriate screws.

Next, the stabilizers 10 and 11 are attached to leg-arm pieces 3 and 4, respectively, with angled portions 13 and 14 (see FIG. 2) facing downwardly. Pan-head screws may be used for this attachment.

Then the main seat piece 12 is laid in.place. Pan-head screws may be used to affix the main seat piece 12 in place.

If desired, a little paint, of white or any desired color, may be dabbed on the screw heads.

The completed chair 15 may be wiped off with a little cleaner, such as Soft-Scrub, to clean off any assembly smudges. The chair 15 may be cleaned with any household cleaner.

The method of the present invention enables the fabrication of a great variety of pieces of furniture, such as benches, chairs, swings, and lounges, which may be changed in appearance to an unlimited number of styles by merely changing solid-state components.

The foregoing description is intended only to be illustrative, but not limiting, of the invention. The invention is intended to cover various modifications and equivalent arrangements.

What is claimed is:

1. A method of making pieces of high-strength weather-resistant indoor/outdoor furniture, comprising the steps of:

designing components for a first piece of furniture which is suitable for indoor and/or outdoor use, and which may be changed in appearance to an unlimited number of styles by merely changing solid-state components through removal of a few screws;

cutting all said components from a single sheet of polymer having a predetermined thickness;

said sheet of polymer is of a solid color with no finishing of any type necessary;

said sheet of polymer comprises a material which is matte finish on both sides, is maintenance-free, rot resistant, and more resilient than wood yet maintains an appearance of painted wood; and assembling said components with screws to form said first piece of furniture.

2. A method according to claim 1, wherein:

each said component is a solid-state component which has no possibility of joint failure because said component has no joints.

3. A method according to claim 1, including the steps of:

changing said first piece of furniture to a second piece of furniture by merely changing solid-state components through the removal of a few screws.

4. A method according to claim 2, including the steps of:

changing said first piece of furniture to a second piece of furniture by merely changing solid-state components through the removal of a few screws.

5. A method according to claim 1, wherein:

said sheet of polymer has a predetermined thickness of no less than 0.5 inches.

6. A method according to claim 2, wherein:

said sheet of polymer has a predetermined thickness of no less than 0.5 inches.

7. High-strength weather-resistant indoor/outdoor furniture, comprising:

components for a first piece of furniture which is suitable for indoor and/or outdoor use, and which may be changed in appearance to an unlimited number of styles by merely changing solid-state components through removal of a few screws;

all said components being fabricated from a single sheet of polymer having a predetermined thickness;

said sheet of polymer is of a solid color with no finishing of any type necessary; and said sheet of polymer comprises a material which is matte finish on both sides, is maintenance-free, rot resistant, UV resistant, and more resilient than wood yet maintains an appearance of painted wood; and said components being assembled with screws to form said first piece of furniture.

8. Furniture according to claim 7, wherein:

each said component is a solid-state component which has no possibility of joint failure because said component has no joints.

9. Furniture according to claim 8, wherein:

said sheet of polymer has a predetermined thickness of no less than 0.5 inches.

10. Furniture according to claim 7, wherein:

said sheet of polymer has a predetermined thickness of no less than 0.5 inches.

11. Furniture according to claim 7, wherein:

said first piece of furniture is changed to a second piece of furniture by merely changing solid-state components through the removal of a few screws.

* * * * *